United States Patent [19]

Bailey et al.

[11] Patent Number: 4,950,134

[45] Date of Patent: Aug. 21, 1990

[54] PRECISION LIQUID DISPENSER

[75] Inventors: David C. Bailey; Carl A. Martin, both of San Jose, Calif.

[73] Assignee: Cybor Corporation, San Jose, Calif.

[21] Appl. No.: 290,258

[22] Filed: Dec. 27, 1988

[51] Int. Cl.[5] ..... F04B 9/08

[52] U.S. Cl. ..... 417/383; 417/18

[58] Field of Search ..... 417/395, 383, 385, 386, 417/387, 388, 505, 902, 532, 18

[56] References Cited

U.S. PATENT DOCUMENTS

| | | | |
|---|---|---|---|
| 3,169,647 | 2/1965 | Lund et al. | 222/309 |
| 3,402,667 | 9/1968 | Bower, Jr. | 417/385 |
| 3,428,042 | 2/1969 | Chesnut | 417/383 |
| 3,601,509 | 8/1971 | Kreitchman | 417/417 |
| 3,847,111 | 11/1974 | Kreutzer | 118/2 |
| 3,963,380 | 6/1976 | Thomas, Jr. et al. | 417/322 |
| 4,321,014 | 3/1982 | Eburn, Jr. et al. | 417/5 |
| 4,345,483 | 8/1982 | Paletta et al. | 73/864 |
| 4,347,131 | 8/1982 | Brownlee | 210/101 |
| 4,475,666 | 10/1984 | Bilbrey et al. | 222/14 |
| 4,483,665 | 11/1984 | Hauser | 417/401 |
| 4,566,868 | 1/1986 | Menzies | 417/18 |
| 4,601,409 | 7/1986 | DiRegolo | 222/1 |
| 4,636,238 | 1/1987 | Sidler | 65/29 |
| 4,690,621 | 9/1987 | Swain | 417/313 |
| 4,769,009 | 9/1988 | Dykstra | 222/390 |
| 4,808,078 | 2/1989 | Havens et al. | 417/38 |
| 4,808,167 | 2/1989 | Mann et al. | 604/151 |

FOREIGN PATENT DOCUMENTS

| | | |
|---|---|---|
| 0077908 | 11/1982 | European Pat. Off. . |
| 1402976 | 4/1964 | France . |
| 2156445 | 10/1985 | United Kingdom . |

*Primary Examiner*—Michael Koczo
*Assistant Examiner*—Robert N. Blackmon
*Attorney, Agent, or Firm*—Baker & McKenzie

[57] ABSTRACT

A precision liquid dispenser embodying the present invention includes a displacement diaphragm pump and a hydraulic system for selectively deforming the diaphragm. The diaphragm pump includes a pump body, a pump cavity, a pump diaphragm, and an input/output port. A solenoid operated valve assembly selectively connects the port to a source of liquid to be dispensed. The hydraulic system for selectively deforming the diaphragm includes a body with a cavity, a piston, a sealing ring, and hydraulic fluid in the space between the piston and diaphragm. The position of the piston is controlled by a stepping motor, a mechanical threaded coupling, which converts rotary motion of the motor output shaft to linear motion of the piston. The volume of fluid dispensed is determined by the number of pulses applied to the stepping motor. The output flow rate as a function of time is controlled by the rate of pulses applied to motor as determined by the control logic. A solenoid valve assembly, under the control of signals from the dispenser control logic, selectively connects a valve input port to the valve input/output port, or connects the input/output port to a valve output port. Valve control signals from control logic are coordinated in time with control signals from the reversible motor.

5 Claims, 1 Drawing Sheet

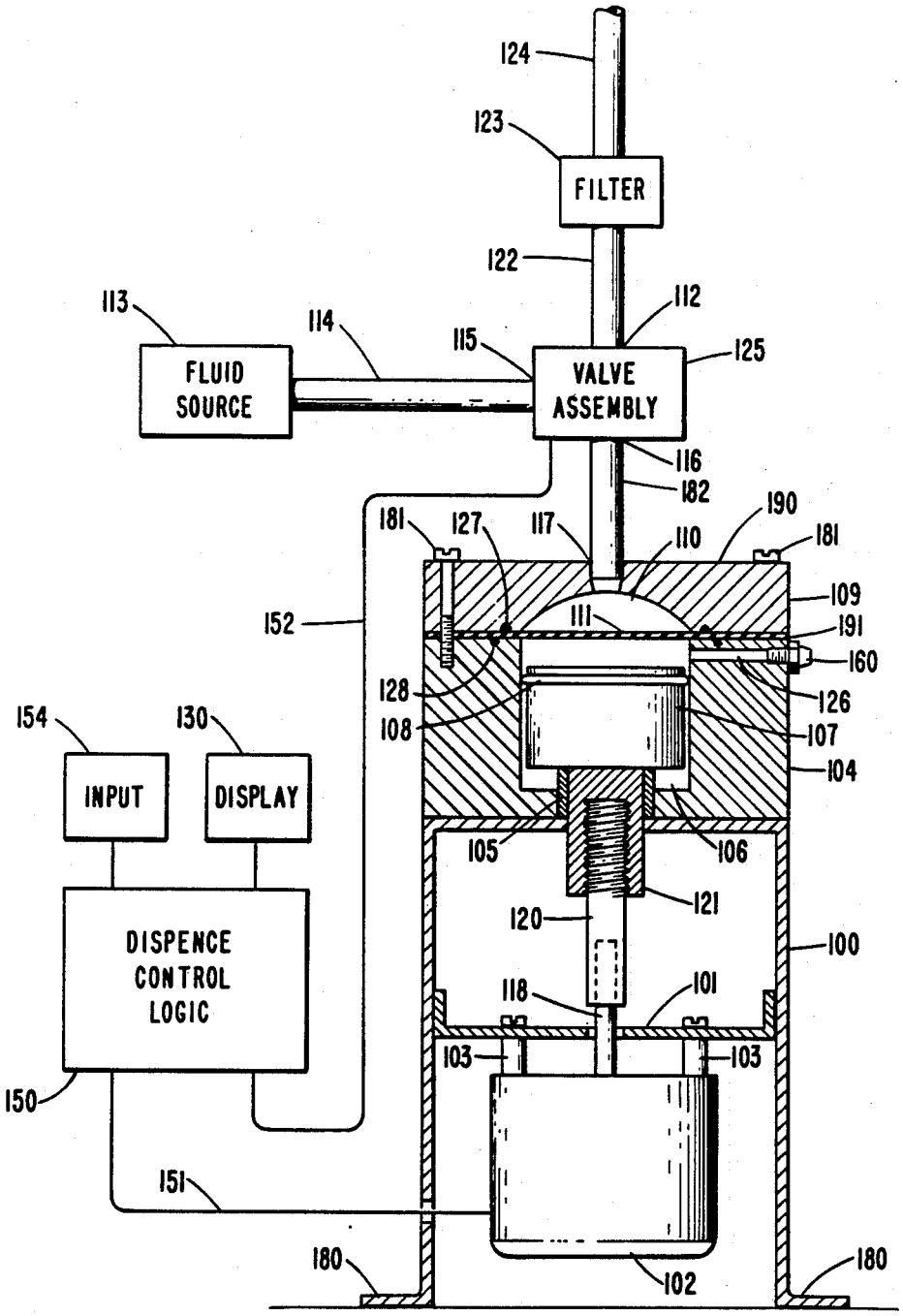
124
123
FILTER
122
112
113
114
115
125
FLUID SOURCE
VALVE ASSEMBLY
116
182
190
181
127
117
110
181
109
152
111
191
160
128
126
108
107
154
130
104
INPUT
DISPLAY
105
106
121
120
100
DISPENCE CONTROL LOGIC
118
101
103
103
150
151
180
102
180

PRECISION LIQUID DISPENSER

TECHNICAL FIELD

This invention relates to liquid dispensers for repetitively discharging substantially equal amounts of liquid with highly reproducible output flow as a function of time.

BACKGROUND OF THE INVENTION

The manufacture of semiconductor apparatus and of various recording media require the application of controlled amounts of liquid to the surface of material in process. It is common practice to dispense liquid to a surface of a wafer or disk which is spinning about it's major axis. The spinning motion causes the liquid to flow evenly over the surface of the disk or wafer. In such applications, uniformity of product requires that the volume of the liquid dispensed and the output flow rate as a function of time be accurately controlled and reproducible.

U.S. Pat. No. 4,690,621, which issued on Sept. 1, 1987, shows a pneumatically operated diaphragm pump which has an integral filter and pneumatically operated valves which are integrated into the pump body.

U.S. Pat. No. 4,483,665, which issued on Nov. 20, 1984 is an example of a bellows type pump which utilizes an external filter, and air under pressure is employed to compress the bellows to discharge liquid from the pump.

As noted earlier herein, the volume dispensed per cycle of pump operation and the rate of discharge as a function of time are important in achieving uniformity of distribution of the liquid to the surface being coated and to uniformity of product.

The use of air or other gases as a driving force, because of their compressibility, does not permit either accurate control of the volume dispensed per cycle or of the dispenser output flow as a function of time.

DISCLOSURE OF THE INVENTION

In accordance with the present invention, a precision liquid dispenser comprises a diaphragm type positive displacement pump; a positive displacement hydraulic driving source for selectively deforming the pump diaphragm; a stepping motor; means for positive coupling of the output of the stepping motor to the input of the hydraulic system; and a controlled source of power for driving the stepping motor.

Advantageously, hydraulic, as opposed to pneumatic, control of the pump diaphragm provides for accurate, reproducible control of both output volume and flow as a function of time; and the use of a stepping motor and a controlled source of power permits easy control of output volume, control of output flow as a source of time, and rapid cycling of the liquid dispenser.

BRIEF DESCRIPTION OF THE DRAWINGS

The single FIGURE illustrates a liquid dispenser in accordance with Applicant's invention.

DETAILED DESCRIPTION OF THE INVENTION

A liquid dispenser in accordance with this invention is generally supplied as a O.E.M. product for integration into a processing system of other manufacturers. In a typical application in semiconductor processing, relatively viscous, reactive materials e.g., positive and negative photoresist, are dispensed in volumes ranging from less than 1 cc per cycle to greater than 15 cc per cycle of dispenser operation; and in some media coating operations, volumes on the order of 60 cc are dispensed at a rate of 0.2 cc/sec to 2.0 cc/sec or more. The rate of discharge during a discharge cycle may be varied with time to achieve the desired product coating. For example, the rate of discharge is controlled per cycle, and positive cut off of flow is achieved by drawback of the fluid.

The dispenser assembly comprises a frame 100 with mounting feet 180. A motor mounting plate 101 is attached to the frame as shown in the drawing; and a reversible stepping motor 102 is attached to mounting plate 101 by fixtures 103.

A screw drive shaft 120 is attached to the motor shaft 118 by a set screw (not shown in the drawing) for positive rotation therewith. External threads on the drive shaft 120 cooperate with mating internal threads of coupling member 121. The mating threads are closely matched to assure precision control of bi-directional linear motion of coupling 120. Coupling member 121 passes through opening 105 in body 104 and is attached to piston 107. Accordingly, piston 107 follows linear motion of coupling 121. Sealing ring 108 prevents leakage of hydraulic fluid as piston 107 is moved up and down in cavity 106. When hydraulic fluid is initially introduced into chamber 106 between diaphragm 111 and piston 107, any air in that chamber is vented through bleed port 160. Accordingly, the hydraulic system is closed except for bleeding of air captured in the system.

The tubular dispenser body 109 has first and second opposing surfaces 190 and 191. A dispenser cavity 110 is formed in the body 109 at the surface 191 and an output orifice 117 couples the cavity 110 to the surface 190. A diaphragm 111 covers the cavity 110 at the surface 191 and extends beyond the sealing 0 ring 127 which is seated in a depression in body 104. Threaded bolts 181 pass through passages in body 109 and engage threads in body 104. The diaphragm 111 is held by compression between bodies 104 and 109. The sealing O rings 127 and 128 respectively prevent leakage of the liquid being dispensed and hydraulic fluid.

The solenoid valve assembly 125, under the control of signals from the dispenser control logic 150, selectively connects valve input port 115 to the valve input/output port 116, or connects the input/output port 116 to the valve output port 112. Valve control signals from control logic 150 are coordinated in time with control signals for the reversible stepping motor 102. The valve assembly 125 may comprise two independent, solenoid operated valves, or a two position three port solenoid valve which provides the above enumerated flow paths. The path from input port 115 to input/output port 116 is employed to introduce liquid to be dispensed into cavity 110 from the liquid source 113; and the path from port 116 to output port 112 is employed to transmit liquid from the dispenser to the output filter 123.

A cycle of dispenser operation comprises the following functions: operate solenoid 125 to close the path between ports 116 and 112 and open path from port 115 to port 116; operate motor 102 to draw piston 107 downward to remove hydraulic pressure from the lower side of diaphragm 111 to introduce fluid into cavity 110 from source 113 via conduit 114, port 115, a passage in valve 125, port 116, conduit 182 and port 117;

operate solenoid 125 to open the path between ports 116 and 112 to close the path from port 115 to port 116; operate motor 102 to drive piston 107 upward to discharge liquid from chamber 110 to output conduit 124 by deforming diaphragm 111; after the defined volume of fluid is dispensed, operate motor 102 to drive piston 107 slightly downward to draw fluid back into conduit 124 to prevent unintended afterflow to the product; and repeat the above described cycle.

During each cycle of operation, the volume of fluid introduced into the system from the source 113 equals the volume dispensed. The above cycle may include a pre-dispense operation in which a small amount of fluid is discharged to waste before the main volume is dispensed to the product. Pre-dispense is achieved by operating the motor 102 to drive the piston 107 slightly upward and momentarily stopping to permit the product to be placed in the path of liquid discharged from conduit 124.

The volume of fluid dispensed in a cycle is directed related to the vertical motion of piston 107, and vertical motion of piston 107 is directly related to the number of pulses delivered to motor 102 from the dispenser control logic 150 via the path 151. At the time of manufacture, the dispenser is calibrated to define the motor control signals required to achieve target volumes to be dispensed and the flow patterns from those volumes. The manual input 154 control permits an operator to define dispenser operating parameters, e.g., the volume of liquid to be dispensed in a cycle of dispenser operation and the rates at which liquid is to be dispensed as a function of time during a cycle of dispenser operation. Display 130 displays the selected parameters and other system data to the operator.

The invention has been described with respect to a preferred embodiment; however, persons skilled in the art may provide variations in implementation without departing from the spirit and scope of the invention.

We claim:

1. In a system for dispensing liquids used in the manufacture of components which require a layer of liquid to be placed thereon, a precision liquid dispenser for dispensing precise amounts of a pumped liquid at controlled rates comprising:

a positive displacement liquid pump having a flexible diaphragm, a pump chamber and a driving chamber on opposite sides of said diaphragm;

an inlet channel and an outlet channel, each being capable of fluid communication with said pump chamber;

valve means for selectively putting said inlet channel in fluid communication between a source of liquid to be dispensed and said pump chamber, and for selectively putting said outlet channel in fluid connection between said pump chamber and a dispensing port;

a hydraulic driving system for selectively deforming said diaphragm;

means for controlling said valve means in coordination with said means for controlling said hydraulic system;

means for controlling said hydraulic system;

said hydraulic system including a piston adjacent to said driving chamber for maintaining a driving liquid in fluid communication with said diaphragm;

said means for controlling said hydraulic system including a reversible stepping motor, motion converting means for changing rotative output motion of said motor into axial motion of said piston to provide bi-directional linear motion of said piston;

said motion converting means comprising a threaded coupling between said motor and said piston;

and a source of electrical signals for controlling said motor.

2. A precision liquid dispenser in accordance with claim 1 wherein:

said means for controlling said hydraulic system includes manual input means for defining the volume to be dispensed in a cycle of dispenser operation.

3. A precision liquid dispenser in accordance with claim 1 wherein:

said means for controlling said hydraulic system includes manual input means for defining the rates at which liquid is to be dispensed as a function of time in a cycle of dispenser.

4. A precision liquid dispenser in accordance with claim 1 wherein:

said threaded coupling includes internal threads on an extension of said piston and external threads on a shaft extending from said motor, said internal and external threads being closely matched.

5. A precision liquid dispenser in accordance with claim 1 wherein:

said pump includes a bleed port communicating with said driving chamber.

* * * * *